US006619043B2

(12) United States Patent
Bruck et al.

(10) Patent No.: US 6,619,043 B2
(45) Date of Patent: Sep. 16, 2003

(54) CATALYST SUPPORT STRUCTURE FOR USE WITHIN CATALYTIC COMBUSTORS

(75) Inventors: Gerald Bruck, Murrysville, PA (US); Maria E. Stampahar, Trafford, PA (US); Dennis M. Bachovchin, Delmont, PA (US); Mary Anne Alvin, Pittsburgh, PA (US); Donald M. Newburry, Broken Arrow, OK (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 23 days.

(21) Appl. No.: 09/965,573

(22) Filed: Sep. 27, 2001

(65) Prior Publication Data

US 2003/0056512 A1 Mar. 27, 2003

(51) Int. Cl.[7] ..... F23R 3/40
(52) U.S. Cl. ..... 60/723; 431/170
(58) Field of Search ..... 60/723; 431/170

(56) References Cited

U.S. PATENT DOCUMENTS 4,072,007 A 2/1978 Sanday
4,731,989 A 3/1988 Furuya et al.
4,870,824 A * 10/1989 Young et al. ..... 60/723
5,202,303 A 4/1993 Retallick et al.
5,512,250 A 4/1996 Betta et al.
5,946,917 A 9/1999 Hums et al.
6,116,014 A 9/2000 Dalla Betta et al.
6,158,222 A 12/2000 Retallick
6,174,159 B1 * 1/2001 Smith et al. ..... 431/170
6,205,768 B1 3/2001 Dibble et al.

* cited by examiner

*Primary Examiner*—Louis J. Casaregola

(57) ABSTRACT

A catalytic combustor includes a plurality of rectangular, tubular subassemblies having the catalyst coating on their outside surfaces. The subassemblies are held in spaced relationship within channels in support walls so that the catalyst coated surfaces of adjacent subassemblies define a catalyst-coated channel, and the interior of the tubular subassemblies defines uncoated channels. This structure permits precise location and support for the various subassemblies, provides wide flexibility in selecting the number and size of catalyst coated subassemblies, and provides for multiple possible flow paths for cooling air and fuel-air mixture through the catalytic combustor.

12 Claims, 9 Drawing Sheets

CATALYST SUPPORT STRUCTURE FOR USE WITHIN CATALYTIC COMBUSTORS

BACKGROUND OF THE INVENTION

1. Field of the Invention

The present invention relates to catalytic combustors. More specifically, the invention relates to an assembly within a catalytic combustor for supporting the catalyst.

2. Description of the Related Art

Combustion turbines, generally, have three main assemblies: a compressor assembly, a combustor assembly, and a turbine assembly. In operation, the compressor compresses ambient air. The compressed air flows into the combustor assembly where it is mixed with a fuel. The fuel and compressed air mixture is ignited creating a heated working gas. The heated working gas is expanded through the turbine assembly. The turbine assembly includes a plurality of stationary vanes and rotating blades. The rotating blades are coupled to a central shaft. The expansion of the working gas through the turbine section forces the blades, and therefore the shaft, to rotate. The shaft may be connected to a generator.

Typically, the combustor assembly creates a working gas at a temperature between 2,500° F. to 2,900° F. (1371° C. to 1593° C.). At high temperatures, particularly above about 1,500° C., the oxygen and nitrogen within the working gas combine to form the pollutants NO and $NO_2$, collectively known as $NO_x$. The formation rate of $NO_x$ increases exponentially with flame temperature. Thus, for a given engine working gas temperature, the minimum $NO_X$ will be created by the combustor assembly when the flame is at a uniform temperature, that is, there are no hot spots in the combustor assembly. This is accomplished by premixing all of the fuel with all of the air available for combustion (referred to as low $NO_x$ lean-premix combustion) so that the flame temperature within the combustor assembly is uniform and the $NO_x$ production is reduced.

Lean pre-mixed flames are generally less stabile than non-well-mixed flames, as the high temperature/fuel rich regions of non-well-mixed flames add to a flame's stability. One method of stabilizing lean premixed flames is to react some of the fuel/air mixture in conjunction with a catalyst prior to the combustion zone. To utilize the catalyst, a fuel/air mixture is passed over a catalyst material, or catalyst bed, causing a pre-reaction of a portion of the mixture and creating radicals which aid in stabilizing combustion at a downstream location within the combustor assembly.

Prior art catalytic combustors completely mix the fuel and the air prior to the catalyst. This provides a fuel lean mixture to the catalyst. However, with a fuel lean mixture, typical catalyst materials are not active at compressor discharge temperatures. As such, a preburner is required to heat the air prior to the catalyst adding cost and complexity to the design as well as generating $NO_x$ emissions. It is, therefore, desirable to have a combustor assembly that bums a fuel lean mixture, so that $NO_x$ is reduced, but passes a fuel rich mixture through the catalyst bed so that a preburner is not required. The preburner can be eliminated because the fuel rich mixture contains sufficient mixture strength, without being preheated, to activate the catalyst and create the necessary radicals to maintain a steady flame, when subjected to compressor discharge temperatures. One flow stream is mixed with fuel, as a fuel rich mixture, and passed over the catalyst bed. The other flow stream may be used to cool the catalyst bed.

One disadvantage of using a catalyst is that the catalyst is subject to degradation when exposed to high temperatures. High temperatures may be created by the reaction between the catalyst and the fuel, pre-ignition within the catalyst bed, and/or flashback ignition from the downstream combustion zone extending into the catalyst bed. Prior art catalyst beds included tubes. These tubes were susceptible to vibration because they were cantilevered, being connected to a tube sheet at their upstream ends. Support for these tubes may be provided by flaring the tube ends, which has the disadvantage of thinning the walls of the tubes by as much as 25%, or providing a baffle-type tube sheet at the downstream end of the tubes, which has the disadvantage of creating counterflow at the downstream end. The inner surface of the tubes were free of the catalyst material and allowed a portion of the compressed air to pass, unreacted, through the tubes. The fuel/air mixture passed over the exterior of the tubes, and reacted with, the catalyst bed. Then, the compressed air and the fuel/air mixture were combined. The compressed air absorbed heat created by the reaction of the fuel with the catalyst and/or any ignition or flashback within the catalyst bed.

The disadvantage of such systems is susceptibility of the tubular configuration to vibration damage resulting from: (1) flow of cooling air inside of the tubes, (2) flow of the fuel/air mixture passing over the tubes transverse and longitudinal to the tube bundle, and (3) other system/engine vibrations. Such vibration has caused problems in the power generation field, including degradation of the joint (e.g. braze) connecting the tubes to the tubesheet and degradation of the tubes themselves, both resulting from tube to tube and/or tube to support structure impacting.

Other proposed catalyst supporting structures include various corrugated plates, having a catalyst coating on one side. Such structures do not provide for the flexibility in gas flow patterns necessary to optimize the efficiency of the combustor.

Accordingly, there is a need for a support structure for a catalyst within a catalytic combustor having the necessary strength to withstand vibrations within the harsh environment of the combustor. Additionally, there is a need for a support structure for a catalyst within a catalytic combustor providing for multiple variations of gas flow patterns through the combustor.

SUMMARY OF THE INVENTION

The present invention is a catalyst supporting assembly for a catalytic combustor, providing increased structural support for the catalyst bearing surfaces, and increased flexibility in directing the air flow through the combuster.

The catalyst supporting structure includes a plurality of rectangular, tubular subassemblies. Each rectangular, tubular subassembly includes a pair of relatively wide surfaces hereinafter arbitrarily referred to as the top and bottom (although any orientation may be utilized). A pair of relatively narrow sides connects the top and bottom along their edges, thereby defining a tube between the top, bottom and pair of sides. The top and bottom may be slightly bent to add structural rigidity. One set of surfaces is coated with a catalyst. In one preferred embodiment, the outside surfaces of the top and bottom are coated with a catalyst. The sides, and the inside of the tube remain uncoated.

A plurality of such catalyst-coated subassemblies may be combined, with the top surface of one subassembly facing the bottom surface of an adjacent subassembly. A pair of support walls on either side of the subassemblies may include channels dimensioned and configured to receive the sides of the subassemblies, thereby supporting the subassemblies along their entire length. The resulting catalytic combustor includes a plurality of alternating catalyst coated and uncoated channels, with the uncoated channels preferably defined within each subassembly, and the coated channels preferably defined between adjacent subassemblies and the support walls.

The number of channels within a catalytic combustor may vary within a wide range, permitting a great deal of flexibility in selecting this number to meet a particular need. For example, a small number of subassemblies may fit within a rectangular catalytic combustor, or a larger number of small size subassemblies may fit within a trapezoidal combustor assembly section. A plurality of trapezoidal subassembly sections, for example, six sections, may surround the pilot nozzle of a combustor.

The flow of cooling air and fuel-air mixture through such a catalytic combustor assembly may be configured along several possible paths. For example, one preferred path may direct cooling air into the subassemblies from one end of the combustor, through the subassemblies, and out the other end of the subassemblies. Within the same embodiments, another portion of the air may be mixed with a fuel, and then directed through openings in the support walls into the catalyst coated channels, wherein it turns downstream and flows through the catalyst coated channels. The cooling air and fuel-air mixture then mix at the end of the combustor assembly.

An alternative preferred cooling air and fuel-air mixture path begins by directing air flowing adjacent to the catalytic combustor through a manifold along the side of the series of alternating coated and uncoated channels. The air may then be passed through openings in the sides of the subassemblies, traveling through the subassemblies and substantially perpendicular to these subassemblies, exiting through openings in the other side of the subassemblies and into another manifold. The cooling air has thereby absorbed some heat from the catalyst-coated channels adjacent to the uncoated channels through which the cooling air has passed. The cooling air may then be directed towards the intake end of the coated channels, and then directed through these channels.

The advantage of such a flow path is increased efficiency from preheating the fuel-air mixture by first utilizing the air to absorb heat from the catalyst coated channels. The preheated air is then mixed with fuel, and passed through the catalyst-coated channels, wherein the reaction between the fuel air mixture and the catalyst causes the fuel-air mixture to heat further.

It is therefore an aspect of the present invention to provide a catalyst supporting structure for a catalytic combustor, wherein the catalyst is applied to rectangular, tubular structures.

It is another aspect of the present invention to provide a catalyst supporting structure for a catalytic combustor, wherein the structure has increased structural support, and resistance to vibration.

It is a further aspect of the present invention to provide a catalytic combustor having multiple possible paths for the cooling air and fuel-air mixture.

It is another aspect of the present invention to provide a catalyst support structure for a catalytic combustor wherein the catalyst is applied to a large surface area, thereby reducing the overall number of parts.

It is a further aspect of the present invention to provide a catalyst support structure for use in catalytic combustors, wherein the various subassemblies may be maintained the proper distance apart, within tight tolerances, without the need for shimming.

It is another aspect of the present invention to provide a catalyst support structure for catalytic combustors wherein the size of the various subassemblies may be easily varied to accommodate various combustor envelopes.

These and other aspects of the invention will become apparent through the following description and drawings.

BRIEF DESCRIPTION OF THE DRAWINGS

Like reference numbers denote like elements throughout the drawings.

DETAILED DESCRIPTION

The preferred embodiments of the invention is a catalyst supporting structure for a catalytic combustor. The catalyst supporting structure provides for improved resistance to vibrations, multiple possible compressed air flow paths to the combustor, a decreased number of components in the assembly, and an increased surface area having a catalytic coating within each subassembly. The significance and function of the present invention is best understood through a brief description of the environment within a combustion turbine for which a catalytic combustor is used.

Figure 1:
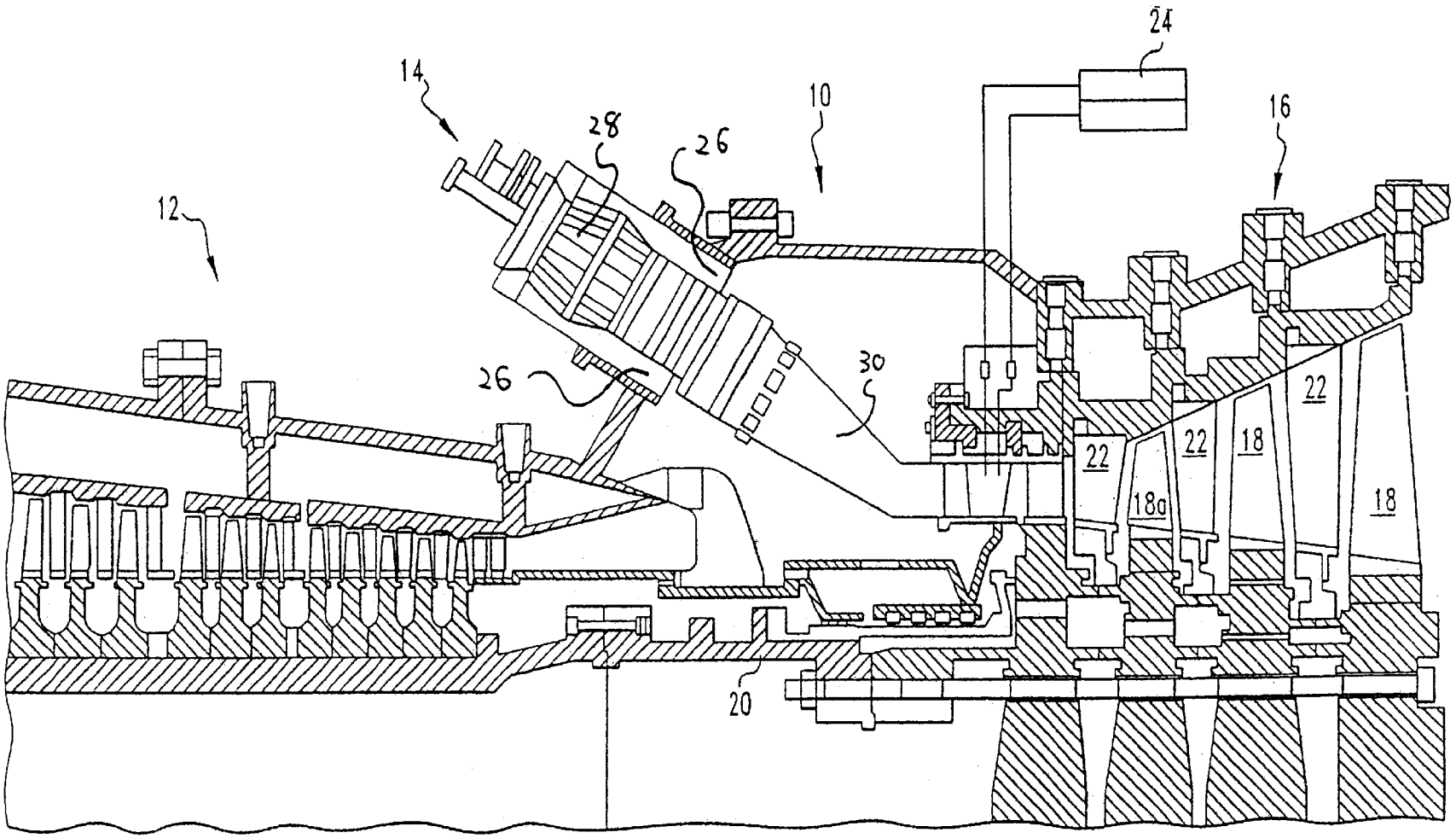
FIG. 1 is a cross-sectional view of a combustion turbine for which a catalytic combustor of the present invention will be used.

FIG. 1 illustrates a combustion turbine 10. The combustion turbine 10 includes a compressor 12, at least one combustor 14, and a turbine 16. The turbine 16 includes a plurality of rotating blades 18, secured to a rotatable central shaft 20. A plurality of stationary vanes 22 are positioned between the blades 18, with the vanes 22 being dimensioned and configured to guide air over the blades 18.

In use, air is drawn in through the compressor 12, where it is compressed and driven towards the combustor 14, with the air entering through air intake 26. From the air intake 26, the air will typically enter the combustor at combustor entrance 28, wherein it is mixed with fuel. The combustor 14 ignites it, thereby forming a working gas. This working gas will typically be approximately 2500° F. to 2900° F. (1371° C. to 1593° C.). This gas expands through the transition member 30, through the turbine 16, being guided across the blades 18 by the vanes 22. As the gas passes through the turbine 16, it rotates the blades 18 and shaft 20, thereby transmitting usable mechanical work through the shaft 20. The combustion turbine 10 also includes a cooling system 24, dimensioned and configured to supply a coolant, for example steam or compressed air, to the blades 18 and vanes 22.

Figure 3:
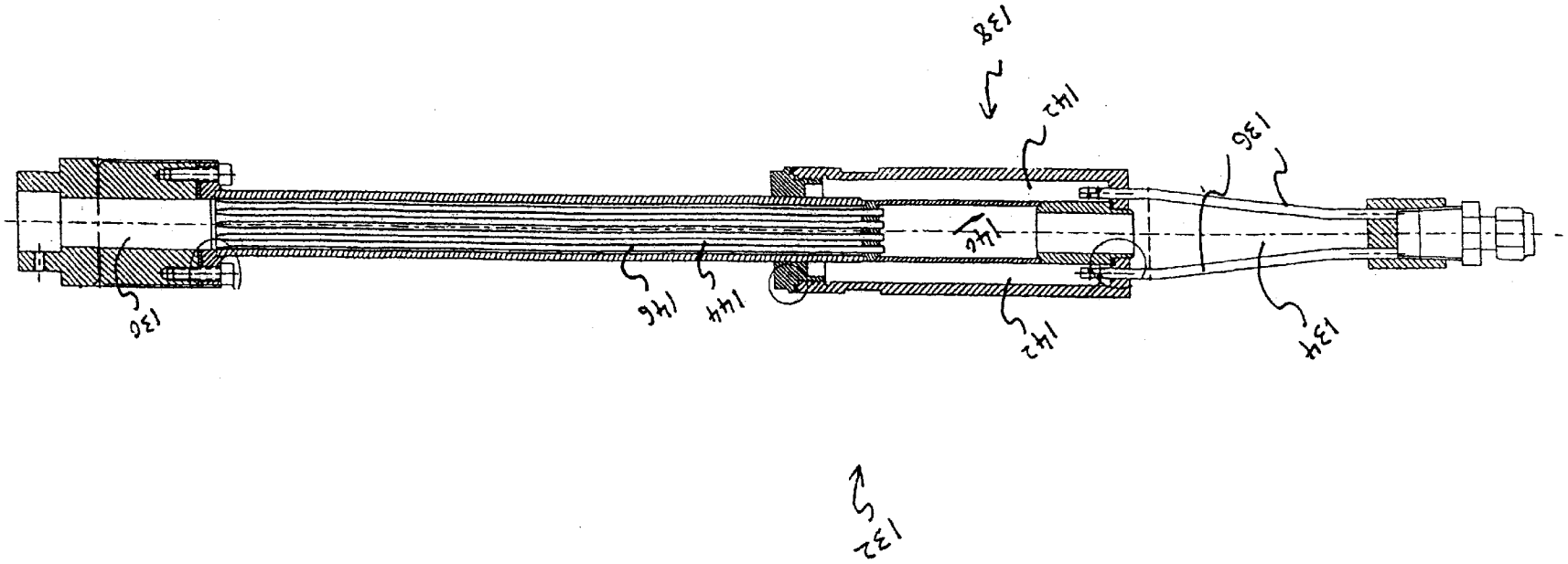
FIG. 3 is a side cross-sectional view of one embodiment of a catalytic combustor according to the present invention.
Figure 4:
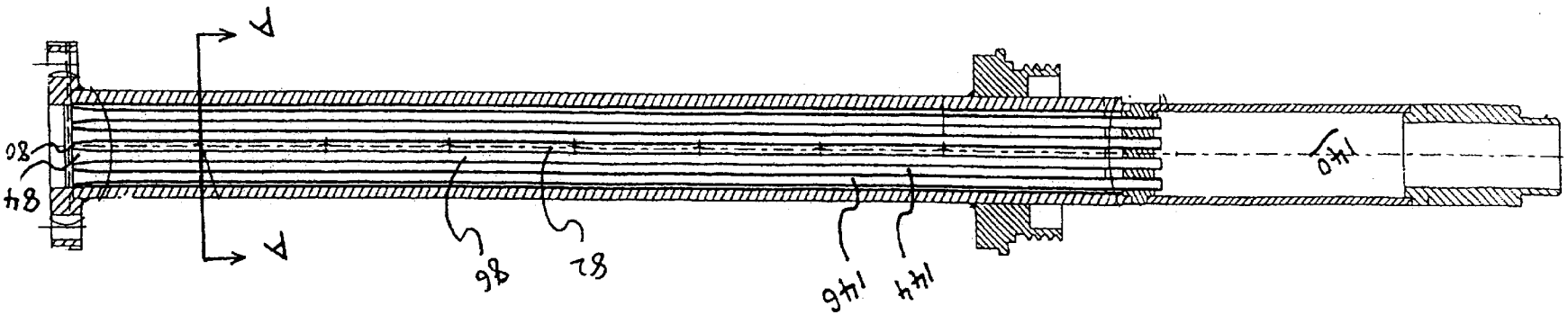
FIG. 4 is a cross-sectional side view of the catalytic combustor embodiment of FIG. 3, focusing on the catalyst supporting plates.
Figure 5:
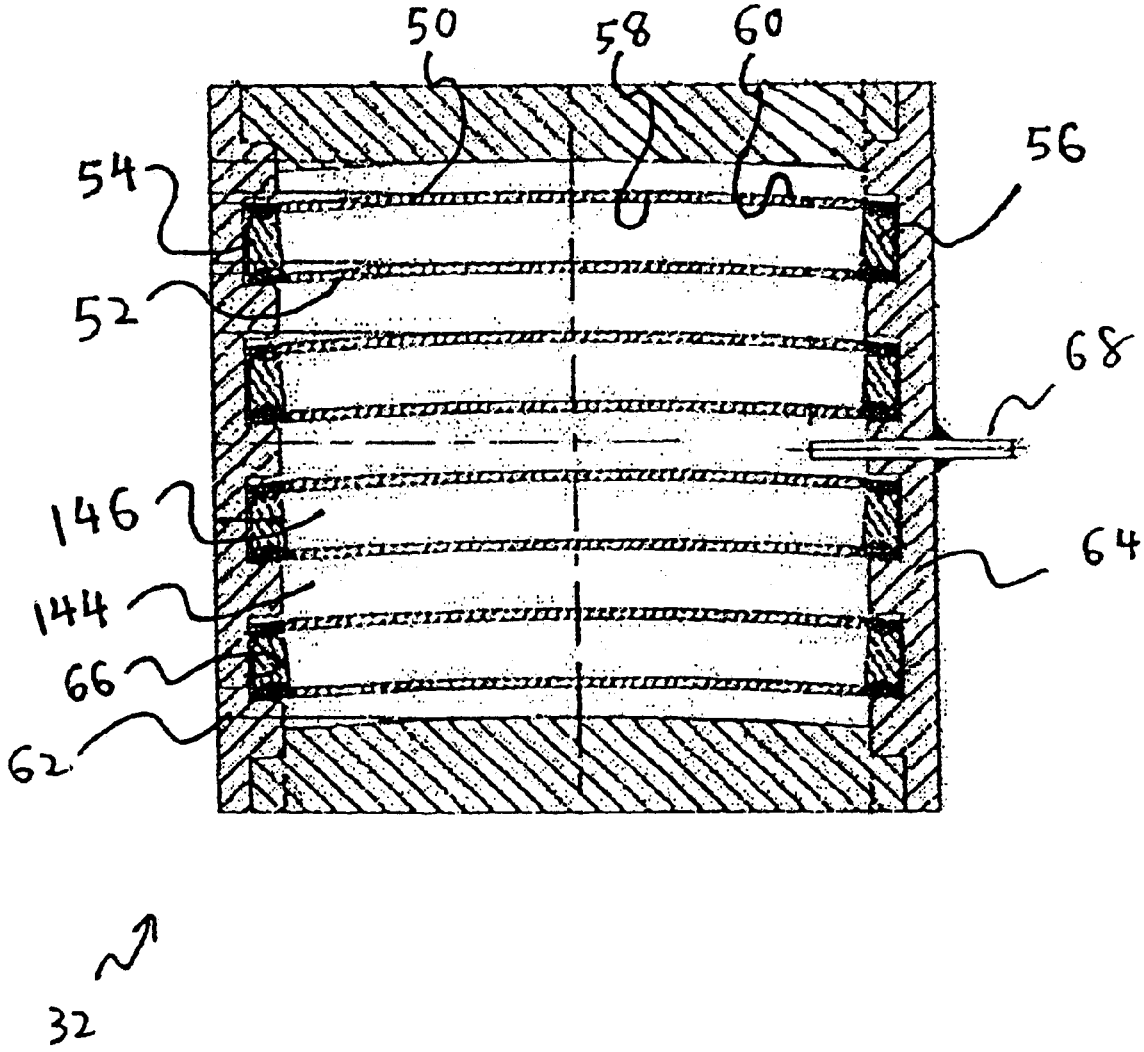
FIG. 5 is a cross-sectional view taken along the lines A—A in FIG. 4 of a catalytic combustor according to the embodiments of FIGS. 3 and 4.

Referring to FIGS. 3–5, one embodiment of the catalytic assembly portion of a catalytic combustor is illustrated. Within this description, two digit numbers 32–46 refer to the general component within all embodiments, and three digit numbers 132–146 and 232–246 refer to the component of a specific embodiment. The catalytic assembly portion 132 includes an air inlet 134, and a fuel inlet 136. The fuel and air are directed from the air inlet 134 and fuel inlet 136 into the mixer/separator portion 138. A portion of the air becomes the cooling air, traveling through the central cooling air passage 140. The remaining air is directed towards the exterior mixing chambers 142, wherein it is mixed with fuel. The catalyst coated channels 144 and cooling channels 146 are located downstream of the mixer/separator portion 138, with the catalyst coated channels 144 in communication with the mixing chambers 142 and the uncoated cooling channels 146 in communication with the cooling air passage 144. A fuel-rich mixture is thereby provided to the catalyst-coated channels, resulting in a reaction between the fuel and catalyst without a preburner, and heating the fuel-air mixture. Upon exiting the catalyst coated channels 144 and cooling channels 146, the fuel air mixture and cooling air mix within the transition member 30, thereby providing a fuel-lean mixture at the point of ignition expanding towards the turbine blades as the fuel/air mixture is ignited and burned.

Referring specifically to FIG. 5, the structure of the catalyst coated and uncoated channels is illustrated. The catalyst coated channels 144 and uncoated cooling air channels 146 are defined by a plurality of tubular subassemblies 48, having an elongated profile when viewed from one end. One preferred elongated profile is substantially rectangular, possibly with a slightly curved profile to add structural rigidity. Each tubular subassembly 48 defines four side portions, which for convenience of reference will arbitrarily be denoted a top 50, bottom 52, first side 54 and second side 56. It should be noted that the tubular subassemblies 48 may be positioned in any orientation. Each tubular subassembly 48 also defines an inside surface 58, and an outside surface 60.

Referring back to FIG. 4, the end portions 86 of the tubular subassemblies 48 are preferably flared with respect to the central portion 88 of each tubular subassembly 48. Therefore, the end portion 82 of each catalyst-coated channel 144 will be tapered, having a smaller cross-sectional area than the central portion 84 of each catalyst-coated channel. This channel profile provides for sufficient flow of fuel-air mixture to prevent backflash (premature ignition of fuel in the combustor).

Adjacent subassemblies are secured together with the top 50 of one subassembly 48 facing the bottom 52 of an adjacent subassembly 48. An important advantage of the elongated profile of the subassemblies 48 is that they can be secured in this position along their entire length by a pair of support walls 62, 64, with the support wall 62 defining a plurality of channels 66, dimensioned and configured to receive the first side 54 of the tubular subassemblies 48, and the support wall 64 likewise defining a plurality of channels 66, dimensioned and configured to receive the second side 56 of the tubular subassemblies 48. Each tubular subassembly 48 is thereby secured at each side 54, 56 by a channel 66 with in a support wall 62, 64. With the tubular subassemblies 48 and support wall 62, 64 assembled in this manner, a plurality of alternating channels are defined, with one set of channels defined within the tubular subassemblies 48, and the other set of channels defined between the tubular subassemblies 48, and the walls 62, 64.

The alternating channels are configured so that one set of channels will include a catalytic surface coating, and the opposite set of channels will be uncoated, thereby forming channels for cooling air adjacent to the catalyst coated channels. These alternating channels may be formed by applying the catalytic coating to either the inside surface 58 or the outside surface 60 of the tubular subassemblies 48. One preferred embodiment includes the catalytic coating applied to the outside surfaces of the top 50 and bottom 52 of each tubular subassembly 48, so that the catalyst coated channels 144 are formed between adjacent tubular subassemblies 48, and the cooling air channels are formed within the tubular subassemblies 48. Some preferred catalyst coatings include platinum, palladium, ruthenium, rhodium, osminium, iridium, flame sprayed titanium dioxide, cerium oxide, vanadium oxide, and chromium oxide.

Figure 2:
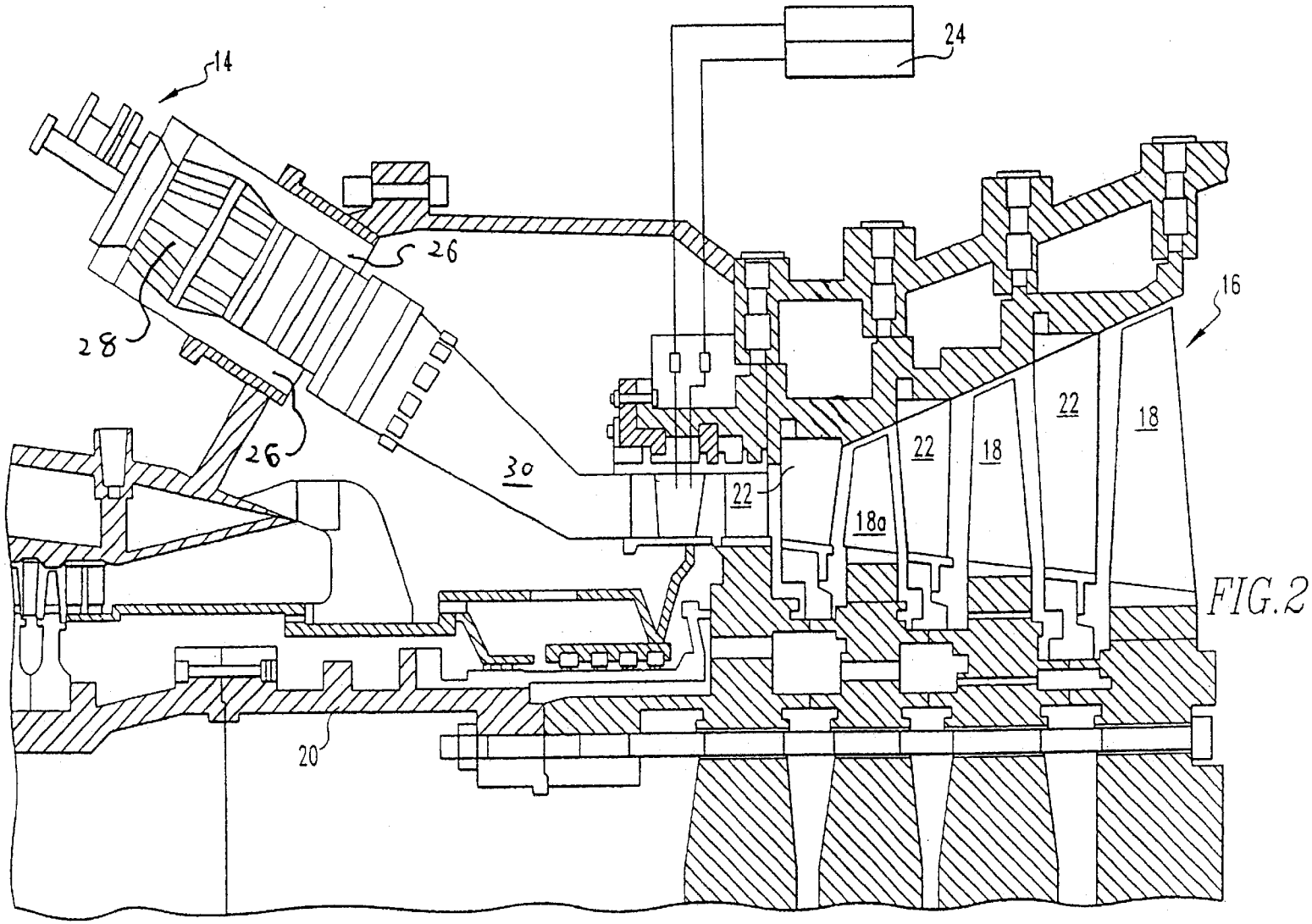
FIG. 2 is a cross-sectional view of the combustion turbine of FIG. 1, focusing on the combustor and turbine portions.

Referring to FIGS. 3 and 4, in use, air exiting the compressor 12 (FIGS. 1 and 2) will enter the air intake 26, proceeding to the air inlet 134. The air will then enter the cooling air passage 140, with some air entering the cooling channels 146, and another part of the air entering the mixing chamber 142, wherein it is mixed with fuel from the fuel inlet 136. The fuel/air mixture will then enter the catalyst coated channels 144. The fuel-air mixture may enter the catalyst-coated channels 144 in a direction perpendicular to these channels, turning downstream once it enters the catalyst-coated channels 144. The catalyst will react with the fuel, heating the fuel/air mixture. At the air outlet 130, the fuel/air mixture and cooling air will mix, the fuel will be ignited, and the fuel/air mixture will then expand into the blades 18 of the turbine 16.

Figure 6:
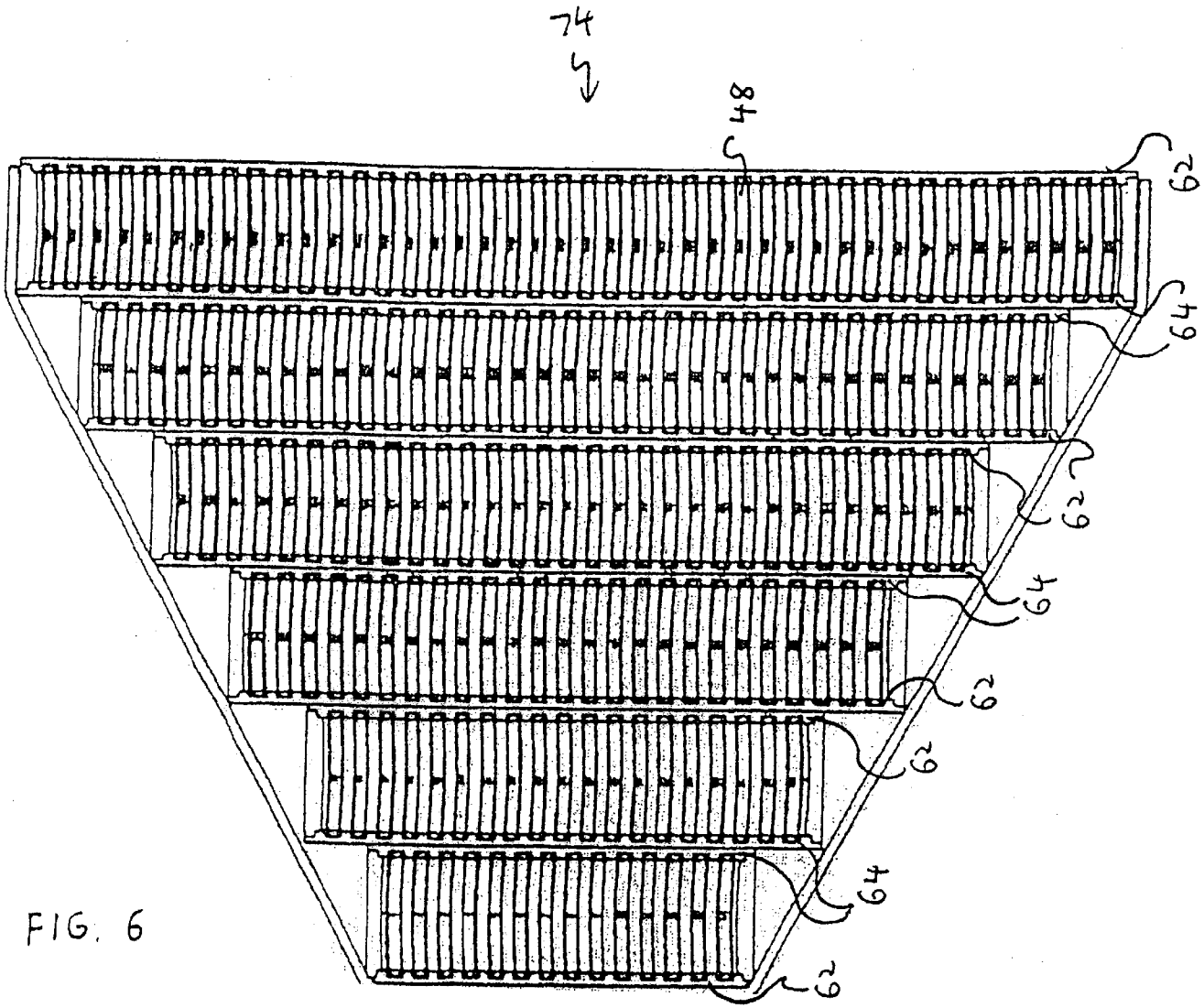
FIG. 6 is an end view of yet another embodiment of the catalytic combustor according to the present invention.

Referring to FIG. 6, a trapezoidal section 74 of a catalytic assembly portion 32 may be made by combining a plurality of tubular subassemblies 48. The tubular subassemblies 48 are preferably organized into a plurality of rows within the trapezoidal section 74, with each row having a first support wall 62 and second support wall 64 securing the tubular subassemblies 48 in place. As before, the tubular subassemblies 48 preferably have an elongated profile when viewed from one end, with a preferred elongated profile being substantially rectangular, possibly with a slightly curved profile to add structural rigidity. Alternating rows 76 may have the curves of the tubular subassemblies 48 oriented in opposing directions, thereby improving the uniformity of mixing of the cooling air and fuel-air mixture at the transition member 130 (shown in FIG. 4).

Figure 7:
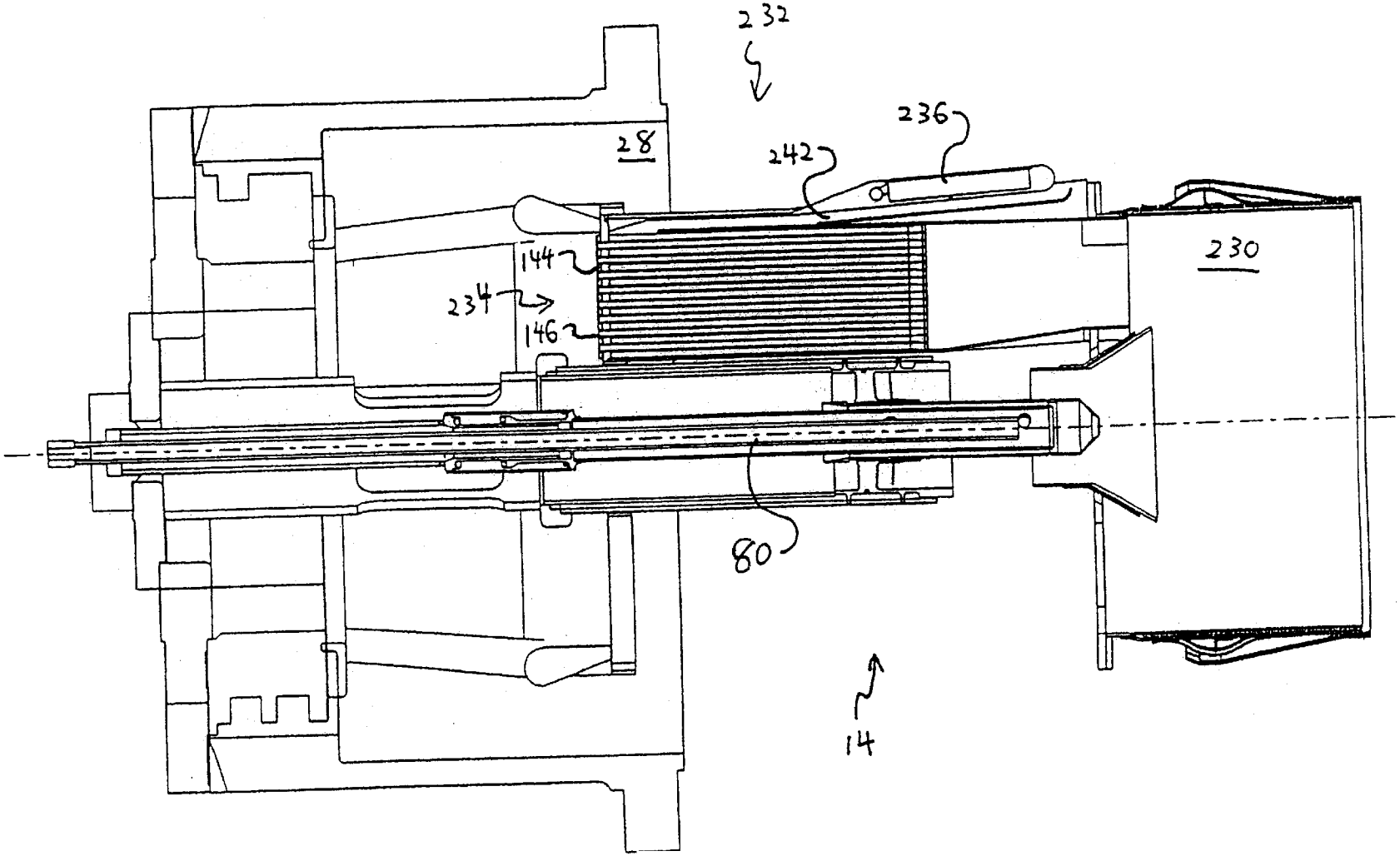
FIG. 7 is a side cutaway view of another embodiment of a catalytic combustor according to the present invention.
Figure 8:
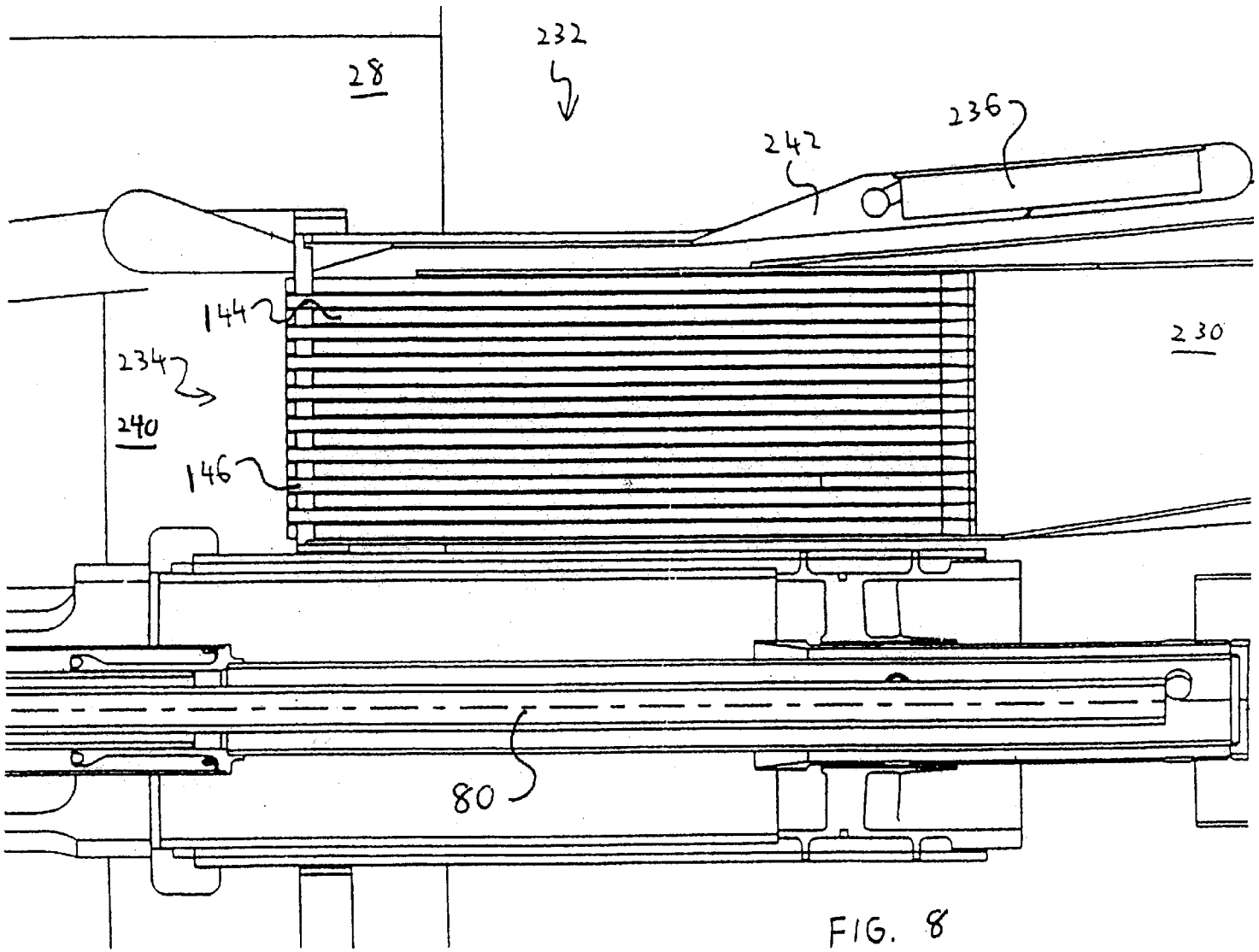
FIG. 8 is a side cutaway view of the catalytic combustor embodiment of FIG. 7, focusing on the catalyst-coated plates.
Figure 9:
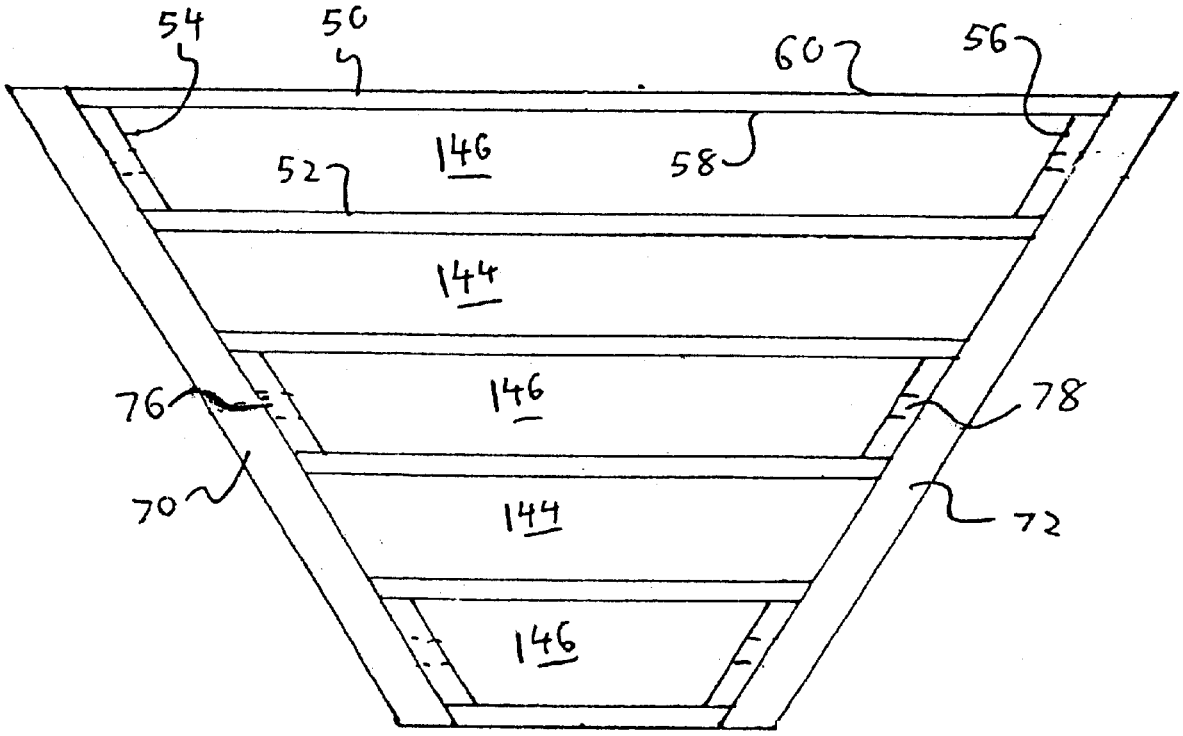
FIG. 9 is an end view of the embodiments of FIGS. 7–8 of a catalytic combustor according to the present invention.

Referring to FIGS. 7–9, a second and third embodiment of the catalytic combustor 14 are illustrated. The catalytic assembly portion 232 includes an air inlet 234, and a fuel inlet 236. Pilot nozzle 80 passes axially through the center of the combustor 14, serving as both an internal support and as an ignition device at transition member 30. The embodiment of FIGS. 6–8 provides for two possible airliows through the catalytic combustor 232. In the first possible airflow, a portion of the air is separated to become cooling air, traveling through the cooling air passage 240. The remaining air is directed towards the mixing chambers 142, wherein it is mixed with fuel. The catalyst-coated channels 144 are in communication with the mixing chambers 142, and the uncoated cooling channels 146 are in communication with the cooling air passage 240. In some preferred embodiments, fuel-air mixture may enter the catalyst-coated channels 144 in a direction substantially perpendicular to these channels, turning downstream once it enters the catalyst-coated channels 144. A fuel-rich mixture is thereby provided to catalyst-coated channels, resulting in a reaction between the fuel and catalyst without a preburner, and heating the fuel-air mixture. Upon exiting the catalyst-coated channels 144 and cooling channels 146, the fuel-air mixture and cooling air mix within the transition member 30, thereby providing a fuel-lean mixture at the point of ignition, expanding towards the turbine blades as the fuel/air mixture is ignited and burned.

Alternatively, referring to FIGS. 7–9, all air entering the combustor entrance 28 may be directed towards towards the air inlet 234, wherein it is directed into the intake manifold 70, and then directed through the holes 76 (shown in FIG. 9) into the uncoated cooling channels 146, in a direction substantially perpendicular to the flow of fuel-air mixture. As the cooling air passes through the uncoated cooling channels 146, the cooling air is heated through heat transfer from the catalyst-coated channels 144. The cooling air is then directed through the holes 78 into the exit manifold 72, into the mixing chamber 142. Fuel is injected into the mixing chamber 142 through the fuel inlet 236, and the resulting fuel-air mixture is directed through the catalyst-coated channels 144. Upon exiting the catalyst-coated channels 144, the fuel-air mixture is ignited and burned, and expands within the transition member 30 towards the turbine blades. This fuel-air path through the catalytic combustor 232 permits the use of a lean fuel-air mixture within the catalyst-coated channels 144 without the use of a preburner, by using the heat generated within the catalyst-coated channels 144 to first heat the air while the air is in the cooling channels 146, so that the resulting fuel-air mixture will have a sufficiently high temperature for the fuel within the fuel-lean mixture to react with the catalyst.

Regardless of which airflow pattern is utilized within the embodiments of FIGS. 7–9, the basic structure of the individual tubular subassemblies 48 forming the alternating catalyst-coated and uncoated channels is preferably identical to that illustrated in FIG. 5.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A catalytic combustor, comprising:

a plurality of tubular subassemblies, each of said tubular subassemblies comprising an inlet end, an outlet end, an exterior surface, and an interior surface, one of said surfaces comprising a catalytic surface coating; and a pair of support walls disposed along opposed longitudinal sides of said tubular subassemblies, said support walls comprising longitudinal grooves, the opposing sides of said subassemblies being disposed within respective ones of said grooves, said support walls securing said tubular subassemblies spaced apart between said support walls, the spaced apart tubular subassemblies defining a series of alternating catalyst-coated and uncoated channels.

2. The catalytic combustor according to claim 1, wherein said tubular subassemblies have a substantially rectangular cross section.

3. The catalytic combustor according to claim 1, wherein a top and bottom wall of said tubular subassemblies have a curved profile when viewed in cross section.

4. The catalytic combustor according to claim 1, wherein said tubular subassemblies further comprise a top, a bottom, and a pair of sides, said sides configured to fit in respective ones of said longitudinal grooves in said support walls.

5. The catalytic combustor according to claim 4, wherein said sides and said support walls define a plurality of apertures dimensioned and configured to permit airflow through said tubular subassemblies, in a direction substantially perpendicular to said tubular subassemblies.

6. The catalytic combustor according to claim 5, further comprising a first manifold adjacent to one of said support walls, and a second manifold adjacent to the opposite of said support walls; said first manifold being dimensioned and configured to direct air into said uncoated channels, in a direction substantially perpendicular to the elongated dimension of said tubular subassemblies, said second manifold being dimensioned and configured to receive air from said uncoated channels, and to direct the air towards said catalyst-coated channels.

7. The catalytic combustor according to claim 1, wherein said catalyst is selected from the group consisting of platinum, palladium, ruthenium, rhodium, osminium, iridium, flame-sprayed titanium dioxide, cerium oxide, vanadium oxide, and chromium oxide.

8. The catalytic combustor according to claim 1, wherein:

said catalyst coated channels include a central portion defining a cross sectional area; and said outlet ends of said catalyst coated channels comprising a cross-sectional area smaller than said central portion's cross sectional area.

9. A catalytic combustor comprising:

a plurality of tubular subassemblies, each of said tubular subassemblies having an inlet end, an outlet end, an exterior surface, and an interior surface, one of said surfaces having a catalytic surface coating; and means for supporting said tubular subassemblies in spaced relationship along substantially an entire length of said tubular subassemblies, and for defining a series of alternating catalyst-coated and uncoated channels, said means further comprising a longitudinal groove.

10. The catalytic combustor according to claim 9, further comprising:

means for directing a first portion of air through said uncoated channels;

means for mixing fuel with a second portion of air; and means for directing the resulting fuel-air mixture through said catalyst-coated channels.

11. The catalytic combustor according to claim 10, further comprising:

means for mixing said fuel-air mixture with said first portion of air after passage of said first portion of air through said uncoated channels and passage of said fuel-air mixture through said catalyst-coated channels.

12. The catalytic combustor according to claim 9, further comprising:

means for directing air into said uncoated channels;

means for receiving air from said uncoated channels, and directing air received from said uncoated channels into said catalyst-coated channels.

* * * * *